US005282741A

United States Patent [19]

Massaro et al.

[11] Patent Number: 5,282,741

[45] Date of Patent: Feb. 1, 1994

[54] GRATE PLATE

[75] Inventors: Micahel R. Massaro, Reading; Bernard H. Schonbach, Allentown; George W. Bryde, Kutztown; Thomas R. Lawall, Emmaus, all of Pa.

[73] Assignee: Fuller Company, Bethlehem, Pa.

[21] Appl. No.: 27,266

[22] Filed: Mar. 5, 1993

Related U.S. Application Data

[63] Continuation of Ser. No. 830,312, Jan. 31, 1992, abandoned.

[51] Int. Cl.[5] ..... F27D 15/02

[52] U.S. Cl. ..... 432/77; 432/78; 110/291; 110/300; 126/163 R

[58] Field of Search ..... 110/289-291, 110/298-300; 432/77, 78

[56] References Cited

U.S. PATENT DOCUMENTS

| | | | |
|---|---|---|---|
| 4,170,183 | 10/1979 | Cross | 110/291 |
| 4,512,266 | 4/1985 | Shigaki | 110/291 |
| 4,563,959 | 1/1986 | Fujiwara | 110/299 |
| 4,762,489 | 8/1988 | Schmits et al. | 110/300 |
| 4,870,913 | 10/1989 | Schneider | 126/163 R |

FOREIGN PATENT DOCUMENTS 0337383 11/1989 European Pat. Off. .

*Primary Examiner*—Henry C. Yuen

[57] ABSTRACT

The present invention pertains to a grate plate utilized in a cooling apparatus.

Substantially the entire surface area of the exposed surface is defined by alternating rows of a plurality of (1) substantially rectangular hollow air distribution plenums that travel substantially the entire length of the exposed area in a direction parallel to the movement of solid material through the cooling apparatus. The air distribution plenums have two side walls and a top surface with which the solid material transported to the cooling apparatus comes into contact, and (2) a plurality of pockets that also travel substantially the entire length of the exposed area in a direction parallel to the movement of solid material through the cooling apparatus. The said side walls of the air distribution plenums each have a plurality of air outlets or portals located thereon through which cooling air passes from the hollow interior of the air distribution plenum into a pocket located adjacent thereto. Preferably, the longitudinal edges of adjoining grate plates in the cooling apparatus are fitted to abut with one another and to thereby form, along the point of juncture of the two grate plates, another air distribution plenum.

16 Claims, 1 Drawing Sheet

GRATE PLATE

This application is a continuation of the patent application Ser. No. 07/830,312, filed on Jan. 31, 1992, now abandoned.

BACKGROUND OF THE INVENTION

The invention relates in general terms to an apparatus for cooling hot material discharged from a kiln.

A cooling apparatus of the general class to which the invention relates is used to cool particulate material (e.g., cement clinker or other mineral materials), which has been burnt in a kiln. Such apparatus can comprise traveling grate coolers, thrust grate coolers, and the like. The hot particulate material discharge from the kiln outlet typically undergoes quenching in the material inlet part of the cooling apparatus and is then moved, distributed as well as possible, to consecutive traverse rows of grates on which additional cooling is then carried out while the material to be cooled is transported along a path extending from the material inlet to the material outlet of the cooler on said grates. Typically, the cooling air which is blown through the hot material in the recuperation zone of the cooling apparatus is then reused or recycled further generally as air for combustion in the preceding kiln.

Grates for cooling or combustion are generally equipped with overlapping rows of grate plates, of which some are mounted in a fixed position and others are reciprocating, which generally means that they oscillate in a longitudinal direction, with the forward stroke of the oscillation being the direction in which the particulate material to be cooled travels through the cooler, and they thereby serve in part to facilitate the movement of the material through the cooler. The grate plates are mounted on a grate support structure, i.e. a carrier beam, which is transverse to the direction of material flow through the cooler. The air needed for cooling or combustion is introduced from below the grate plates through port like openings to enter, penetrate and pass through the bed of material to be cooled or burned, with said material lying on top of the grate plate.

The grate plates are subject to wear through mechanical and thermal effects. In the case of cooling grates for instance, the exposed area of the grate, which lies closer to the discharge end of the cooler, is subject to considerable mechanical wear and thermal exposure, whereas the rear, unexposed, part of the grate plate is subject to less wear, and only minimal thermal exposure.

Grate plates are provided in numerous configurations. One popular configuration is the so-called flat grate plate style, which, as its name implies, employs a flat surface on which the clinker is supported as it is transported through the cooler. In this style, ports through which cooling air passes are located on the surface of the grate. Clinker will therefore rest directly on top of the ports. There will always exist the possibility that clinker will sift through the ports, clog the air passageways and at times fall on the underlying supporting structure, causing possible damage to the supporting structure and, at times, an uneven distribution of cooling air flow resulting in a grate plate system having hot areas.

Over the years, there have been notable variations in style from the so-called flat grate configuration. One such variation, for example, is the wedge grate style in which the front area, which comprises part of the exposed area of the grate, is bent or inclined upward at an angle relative to the flat, horizontal plane of the remaining area of the grate. This design provided a partially defined area, at the point of the bend, in which the clinker could rest on the surface of the grate. This design also served to slow the flow of clinker through the cooler, which ultimately was somewhat successful in retarding red river conditions within the cooler. Air typically was distributed into the clinker through openings located in the upwardly inclined area of the grate plate. This design did not contain any anti-sifting features, as smaller particles of hot clinker could enter and clog the air distribution holes or pass through the holes into the air distribution compartments below the grate. In addition, there was only a limited tendency for the clinker to remain static within this particular design of grate. This design was utilized primarily in the mid 1950's through the 1960's.

Such prior art designs did not have any anti-sifting features and had high discharge velocities of air through the air distribution holes into the clinker. It would be advantageous, therefore, to provide for a design of grate plate which has anti-sifting features and lower discharge velocities of air through the air discharge holes and which will hold clinker in a static condition on the surface of the grate plate, thus reducing the possibility of excessive wear on the surface of the grate plate.

SUMMARY OF THE INVENTION

The present invention relates to a grate plate for transporting particulate and solid material in a predetermined direction through a cooling apparatus. The invention is particularly useful in the cooling of cement clinker after it exits a kiln. The cooling apparatus in which the grate plate is employed is comprised of a material inlet, a material outlet, and a plurality of rows of grate plates, which typically alternate between being stationary or reciprocating. Each row of grate plates extends across the width of the cooler in a direction transverse to the material flow through the cooler. Each preceding row of plates overlaps the following row of plates. The under surface of each grate plate is attached to a grate support such as a carrier beam. The upper surface of the grate plate is divided between an exposed area, which, if the grate were positioned in any other but the first row from the material inlet, would never be overlapped by any portion of a preceding grate. The exposed area is located on the front portion of the grate plate, that is, the portion which is closer to the material outlet end of the cooler. The remainder of the grate plate consists of an unexposed area, which, if the grate plate would be located in any other but the first row of the cooling apparatus, would be overlapped at least part of the time by a preceding grate.

In the grate plate of the present invention, substantially the entire surface area of the exposed surface is defined by alternating rows of air distribution plenums and rectangular shaped pockets in which particulate material will rest in a static condition. Specifically, there is at least one, and preferably a plurality of substantially channel-like air distribution plenums, which travel in their longitudinal direction, substantially the entire distance of the exposed area, which direction is substantially parallel to the movement of material through the cooling apparatus. The top surface of the plenums are substantially level with the top surface of the grate plate. The plenums are in connection with a source of cooling air. The tubular air distribution plenums have a top surface and at least one longitudinal side, which forms one of the longitudinal sides of an adjacent pocket. Cooling air will enter the interior of the air distribution plenum from the under side of the grate plate, will travel along the length of the plenum and will exit the plenum into an adjacent pocket via a plurality of air portals or outlets that are located in the longitudinal side walls of the plenum. The cooling air is directed through material that is retained within the pockets adjacent to the plenums. The air will then work its way up through any material that is located above the top surface of the grate plate. As indicated, the air distribution plenum is adjacent on one or more of its longitudinal sides (depending upon whether the plenum is located at the side or toward the center of the grate plate) to a basically rectangularly shaped pocket or cavity in which particulate material will reside. The pockets will run, in their longitudinal direction, substantially the entire length of the exposed area, which direction is parallel to the movement of material through the cooling apparatus. The grate plate will contain a plurality of such pockets and, preferably, between three to six pockets. The embodiment depicted in the enclosed FIGURE has four pockets. The pockets are either located between two adjacent air distribution plenums or between an air distribution plenum and a inner side wall (which, in the preferred embodiment of the present invention, will also function as an air distribution plenum when combined with an inner side wall of an adjacent identical grate plate) of the exposed area of the grate plate. Thus, there is an alternating placement of air distribution plenums and pockets over substantially the entire exposed area of the grate plate. The exposed area is bordered by the front pusher face, the side walls of the exposed area of the grate plate and the front side of the unexposed area running parallel to the front pusher face.

One of the advantages of the design of the cooling air distribution system of the grate plate of the present invention is that the pockets that are present in the exposed area will essentially accommodate the material that resides therein in a static condition. The reduction of movement of material relative to the exposed metal surface area of the grate plate will significantly reduce the wear in said section. Another advantage of the design of the grate plate of the present invention is that the cooling air will enter the pockets from air ports that are located in the longitudinal side walls of the air distribution plenums. Thus, particulate material will not rest directly on top of these ports and, accordingly, there will not be as great a tendency for particulate material to sift into the ports, thus clogging them and obstructing the unhindered passage of air therethrough.

DESCRIPTION OF THE INVENTION

Figure 1:
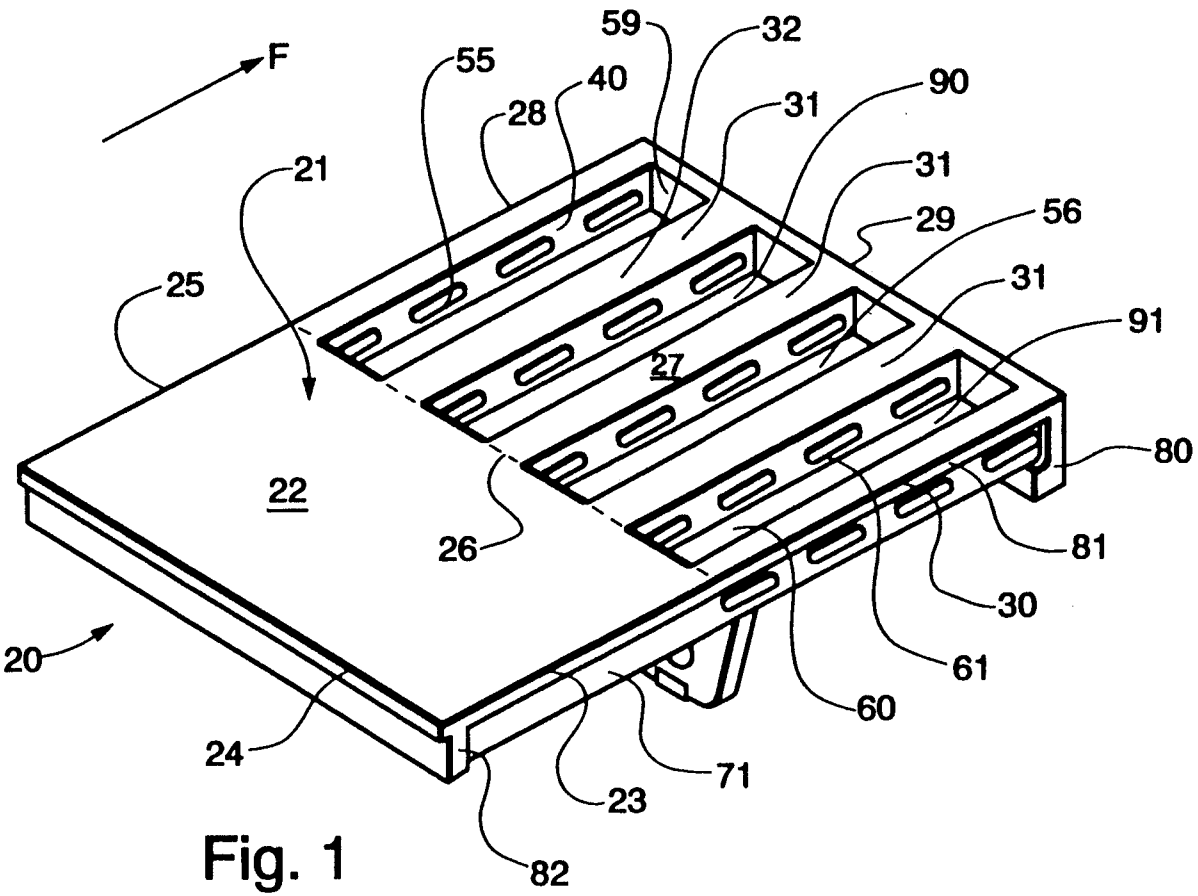
FIG. 1 depicts a top view of one of the preferred embodiments of the present invention.

Referring to FIG. 1, there is depicted one embodiment of the grate plate of the present invention generally referred to by the numeral 20, which can be utilized in a stationary or reciprocating mode.

The view of grate plate 20 as set forth in FIG. 1 is generally of its upper surface 21, which upper surface is divided into an unexposed area generally referred to as 22, the boundaries of which are as defined by edges 23, 24, 25 and dotted line 26, and an exposed area 27, the boundaries of which are defined by dotted line 26 and edges 28, 29 and 30. Material will travel through the cooler longitudinally in the direction represented by arrow F.

As material moves through the cooler it will generally fall onto the exposed area. The surface of the unexposed area 22 will be covered during the operation of the cooler at least part of the time by an overlap created by the grate plate immediately behind it in the cooler, if any, keeping in mind that said preceding grate plate can be either stationary or reciprocating.

The grate plate will have a plurality of plenums 31, with the upper surface 32 of the plenums 31 being generally in the same plane as the upper surface of the unexposed area 22 of the grate plate 20. Furthermore, the upper surface 32 of the plenums 31 will also be the upper surface of exposed area 27.

As indicated, there is located on the exposed area 27, at least one, and preferably a plurality of substantially rectangular, hollow air distribution plenums 31, through which cooling air travels. Cooling air can be provided to the hollow interior of the air distribution plenums via a number of ways. For example, in one embodiment cooling air can be provided from carrier beams (not shown) located beneath the grate plate 20. Cooling air can enter the interior of air plenums 31 horizontally from the under portion of the grate plate near the junction point of the exposed and unexposed areas. Cooling air can also enter air plenums 31 in a vertical fashion. As indicated, air plenums 31 are essentially hollow structures containing an interior air passageway (not shown) through which air travels. The plenums 31 will travel, in their longitudinal direction, essentially the entire horizontal length, which direction is parallel to the flow of material through the cooler, of the exposed area. Cooling air will generally travel through the air conduits lengthwise in the interior passageways in the same direction as material flow, that is, from rear to front. Cooling air is discharged from the air distribution plenums 31 through air portals 55 into rectangular pockets 56, the longitudinal direction of which, like air distribution plenums 31, run substantially the entire length of the exposed area, and alternate with plenums 31 to take up substantially the entire exposed area. Pockets 56 can be either centrally located between two adjacent central air distribution plenums 31 or between an inner longitudinal side wall, one such side wall being depicted by the numeral 40, and a central air distribution plenum 31, with one such pocket that is located in such a fashion being designated in FIG. 1 by the numeral 90.

As depicted in FIG. 1, the air distribution plenums designated by the numeral 31 are centrally located on grate plate 20, that is, they are not located adjacent to edges 28 and 30. However, it is a feature of the present invention that two adjacent grate plates located in any given row of grate plates extending across the width of the cooler will form, at their point of juncture along the exposed portion of their lengthwise sides, another air distribution plenum. This feature is possible in part because of the presence of air distribution portals 55 in the side walls of the grate plate, one such side wall being depicted by the numeral 71. In addition, side 80 forms a ledge that overhangs side wall 71. When the grate plate 20 is brought together with an identical adjacent grate plate, sides 80, 81 and 82 will mate with their corresponding members on the adjacent grate plate and, in combination, the two plates will form another air distribution plenum through which air will be discharged through the air portals into rectangular pocket 91 and its corresponding member on the adjacent grate plate. This feature provides for better cooling of material that resides in rectangular pockets, such as 91, that are not centrally located on the grate plate.

As indicated, pocket 56 is generally rectangular in shape. The pocket 56 is generally formed by two longitudinal side walls similar to wall 40, two traverse side walls such as 59 and base 60. The configuration of pocket 56 will of course be dependent on the shape of the longitudinal and traverse side walls and base 60. It is also appreciated that side walls 58 function as the side walls of both the pocket and the adjacent air distribution plenum.

Air passing through air portal 55 will be directed into pocket 56, preferably at an downward angle. It is this downward angle of air portal 55, in combination its location on the side walls of the air plenums, that is the primary reason for the essentially sift-free condition of grate plate 20.

At their exit point on the side walls 58, air portals 55 will preferably be in the form of rectangular shaped slots as depicted in the FIGURE. The longitudinal sides 61 of the slots are substantially parallel to the direction of flow of material through the cooler. The exit slots are preferably located about halfway up longitudinal walls 58. Since the exit slots of air portals 55 are positioned on longitudinal walls 58, air is initially discharged from air portal 55 in a direction transverse to the material flow through the cooler. Furthermore, rather than there being one slot in each side wall 58 that would run all or most of the length of air distribution plenum 30, there are a plurality of slots positioned along the length of each longitudinal wall 58. It has been found that this configuration has a number of advantages. For instance, the structural integrity of the grate plate is enhanced. The slots maintain a transport velocity which will minimize the backflush of material into the air plenum. Further, the design will minimize the discharge velocity thus providing a number of advantageous, typically, reducing the potential for fluidization during normal and red river states, enhancing the heat recuperation, providing for higher secondary air temperatures, promoting a greater retention factor of cooling air within the retained material mass, promoting less abrasive characteristics to the grate which typically result from high velocity entrained particles abrading the air outlets in the surrounding grate plate surface and improving quenching, to name a few.

The length and width of the exit slots may vary. Generally, the slots should be placed so that there is an even distribution of air throughout the entire exposed area of the grate plate. In addition, the slots can be positioned so that a slot will directly face a corresponding slot on the longitudinal wall directly opposite thereto. Alternatively, the slots on opposite walls can be staggered from one another.

Pockets 56 will generally be wider than plenums 30. It has been determined that a preferred configuration for the pockets 56 is when their length to width ratio ranges from about 3-1 to about 15-1 and more preferably from about 4-1 to about 8-1.

One or more of the air plenums and/or pockets within a given grate plate may optionally have variable widths from a corresponding plenum or pocket. In particular, air plenums that are located against the side edge of the grate plate will generally be narrower than their counterparts located in middle areas of the grate. In another embodiment, all of the pockets and/or all of the air plenums may be of the same width.

As indicated, the longitudinal edges of the grate plate will preferably be identical in height and shape to each other to cause adjoining grate plates to abut rather than overlap. In particular, the longitudinal edges of adjacent grate plates, when joined together in a row will combine to form another air distribution plenum.

In other embodiments, the placement of the air portals of the side walls will vary. For example, the air portals may be so located so that air from an air portal will enter an adjacent pocket horizontally at the base of the pocket, rather than entering at the general mid section of the pocket conduit in a downwardly direction, as is the case in the embodiment depicted in the FIGURE.

We claim:

1. A grate plate for transporting particulate material in a predetermined direction through a cooling apparatus that has a material inlet, a material outlet, and a plurality of rows of grate plates, with each preceding row of plates overlapping a portion of the following row of plates, said grate plate having an upper surface which is divided between an exposed area and a non-exposed area, wherein:

substantially the entire exposed area is defined by alternating rows of (a) substantially rectangular hollow air distribution plenums that, in their longitudinal direction, travel substantially the entire distance of said exposed area, which direction is parallel to the movement of material through the cooling apparatus, said air distribution plenums having a top surface with which some particulate material being transported through the cooling apparatus comes into contact, and two side walls and (b) a plurality of rectangular pockets, which, in their longitudinal direction, travel substantially the entire distance of the exposed area, said direction being parallel to the movement of particulate material through the cooling apparatus;

wherein said side walls of said air distribution plenum each have a plurality of air portals located thereon through which cooling air passes from the interior of the air distribution plenum through said air portal into an adjacent pocket.

2. The grate plate of claim 1 wherein at least some of the air portals are in the form of rectangular slots on the side walls of the air plenum, said slots having their longitudinal side parallel to the direction of material movement through the cooler.

3. The grate plate of claim 1 wherein the cooling air passes through the air portals in a downward direction into an adjacent pocket.

4. The grate plate of claim 1 wherein the cooling air enters an adjacent pocket at its base.

5. The grate plate of claim 1 wherein at least two air distribution plenum have varying widths.

6. The grate plate of claim 1 wherein at least two pockets have varying widths.

7. The grate plate of claim 1 wherein the length to width ratio of the pockets ranges from about 3-1 to about 15-1.

8. The grate plate of claim 7 wherein the length to width ratio of the pockets ranges from about 4-1 to about 8-1.

9. The grate plate of claim 1 wherein at least one air distribution plenum is separated from the longitudinal side wall of the exposed area by a pocket.

10. The grate plate of claim 1 having at least one air distribution plenum that is located against the longitudinal side walls of the exposed area.

11. The grate plate of claim 1 wherein substantially all the material that resides within the exposed area is in a static condition.

12. The grate plate of claim 1 wherein the longitudinal edges of adjoining grate plates in the cooling apparatus are fitted to abut with one another and to thereby form, along the point of juncture of the two grate plates, an air distribution plenum.

13. The grate plate of claim 1 wherein the material is cement clinker.

14. The grate plate of claim 1 wherein the number of pockets range from three to six.

15. The grate plate of claim 1 wherein there are four pockets.

16. A grate plate for transporting particulate material in a predetermined direction through a cooling apparatus that has a material inlet, a material outlet, and a plurality of rows of grate plates, with each preceding row of plates overlapping a portion of the following row of plates, said grate plate having an upper surface which is divided between an exposed area and a non-exposed area, wherein:

substantially the entire exposed area is defined by alternating rows of (a) substantially rectangular hollow air distribution plenums that, in their longitudinal direction, travel substantially the entire distance of said exposed area, which direction is parallel to the movement of material through the cooling apparatus, said air distribution plenums having a top surface with which some particulate material being transported through the cooling apparatus comes into contact, and two side walls and (b) a plurality of rectangular pockets, which, in their longitudinal direction, travel substantially the entire distance of the exposed area, said direction being parallel to the movement of particulate material through the cooling apparatus;

wherein said side walls of said air distribution plenum each have a plurality of air portals located thereon through which cooling air passes from the interior of the air distribution plenum through said air portal into an adjacent pocket, wherein at least some of the air portals are in the form of rectangular slots on the side walls of the air plenum, said slots having their longitudinal side parallel to the direction of material movement through the cooler;

the longitudinal edges of adjoining grate plates in the cooling apparatus being fitted to abut with one another and to thereby form, along the point of juncture of the two grate plates, an air distribution plenum.

* * * * *